US007608030B2

(12) United States Patent
Splane

(10) Patent No.: US 7,608,030 B2
(45) Date of Patent: Oct. 27, 2009

(54) EXERCISE CHAIR

(75) Inventor: Robson Splane, Valley Center, CA (US)

(73) Assignee: Guthy-Renker Corporation, Santa Monica, CA (US)

( * ) Notice: Subject to any disclaimer, the term of this patent is extended or adjusted under 35 U.S.C. 154(b) by 231 days.

(21) Appl. No.: 11/346,142

(22) Filed: Feb. 2, 2006

(65) Prior Publication Data

US 2007/0037677 A1 Feb. 15, 2007

Related U.S. Application Data

(60) Provisional application No. 60/706,983, filed on Aug. 10, 2005.

(51) Int. Cl.
*A63B 26/00* (2006.01)

(52) U.S. Cl. ..... 482/142; 482/140

(58) Field of Classification Search ..... 482/140, 482/142, 126, 129–137, 148, 79–80, 121–123, 482/139; 297/423.1, 461; D21/191; 601/56
See application file for complete search history.

(56) References Cited

U.S. PATENT DOCUMENTS

| | | | | | |
|---|---|---|---|---|---|
| 3,473,843 | A | | 10/1969 | Hart | |
| 3,707,284 | A | | 12/1972 | Waldeck | 482/130 |
| 4,448,412 | A | * | 5/1984 | Brentham | 482/112 |
| 4,466,613 | A | * | 8/1984 | Reese | 482/123 |
| 4,648,593 | A | | 3/1987 | Wilkinson | 272/70 |
| 5,002,271 | A | * | 3/1991 | Gonzales | 482/130 |
| 5,044,633 | A | * | 9/1991 | Rice | 482/138 |
| 5,090,694 | A | | 2/1992 | Pauls et al. | 272/134 |
| D342,106 | S | | 12/1993 | Campbell et al. | D21/191 |
| 5,316,528 | A | | 5/1994 | Ziparo | 482/52 |
| D380,242 | S | | 6/1997 | Wang et al. | D21/676 |
| 5,681,249 | A | | 10/1997 | Endelman | 482/142 |
| 5,690,594 | A | | 11/1997 | Mankovitz | 482/121 |
| 5,865,710 | A | | 2/1999 | Wilson-Hyde | 482/52 |
| 5,868,654 | A | * | 2/1999 | Norian | 482/140 |
| 6,056,675 | A | | 5/2000 | Aruin et al. | 482/91 |
| 6,117,056 | A | | 9/2000 | Cataldi, Jr. et al. | 482/121 |
| 6,129,651 | A | | 10/2000 | Denaro | |
| 6,371,895 | B1 | | 4/2002 | Endelman et al. | 482/135 |
| 6,634,997 | B2 | * | 10/2003 | Breibart et al. | 482/130 |
| 6,676,581 | B1 | * | 1/2004 | Lin | 482/148 |
| 2002/0137607 | A1 | | 9/2002 | Endelman | 482/123 |
| 2003/0119635 | A1 | | 6/2003 | Arbuckle et al. | 482/142 |

(Continued)

FOREIGN PATENT DOCUMENTS

| | | |
|---|---|---|
| WO | WO 96/36402 | 11/1996 |

*Primary Examiner*—Lori Amerson
(74) *Attorney, Agent, or Firm*—Cislo & Thomas, LLP

(57) ABSTRACT

An exercise chair primarily directed to employing an exercise method, with independent, adjustable foot bars and a foldable configuration. The seat is supported by a plurality of support elements, at least some of which are hingeably connected with the seat, so that the chair can be folded into a compact shape for storage or transport. The independent foot bars may each be attached to a lever that is hingeably coupled with one or more of the support elements. The position of the foot bars may also be adjustable by extending out of the levers and locking into the desired position. One or more resistance elements may be removably attached to a location below the chair seat, and individually connected with the levers via an adjusting assembly that can either slide or be placed in pre-set mounting locations along the lever to provide variable resistance, or can be equipped with a turnbuckle to provide varying resistance. A platform that rests at or near the floor during use may be attached to the two front support elements, which provides stability as well as comfort when the user stands or kneels on the platform when using the chair.

24 Claims, 10 Drawing Sheets

U.S. PATENT DOCUMENTS

2004/0043880 A1 3/2004 Johnston ..... 482/148
2004/0138034 A1 7/2004 Endelman ..... 482/121
2004/0152572 A1 8/2004 Reitz et al. ..... 482/140
2004/0229738 A1 11/2004 Hobson ..... 482/148
2007/0161470 A1* 7/2007 Berryman ..... 482/94
2008/0119333 A1* 5/2008 Bowser ..... 482/62

* cited by examiner

EXERCISE CHAIR

CROSS REFERENCE TO RELATED APPLICATION

This patent application claims benefit of U.S. Provisional Patent Application No. 60/706,983, filed Aug. 10, 2005, which is hereby incorporated by reference.

TECHNICAL FIELD

This invention relates to the field of exercise equipment, employing the exercise method developed by Joseph H. Pilates generally, as well as to exercise equipment that is not restricted to use with traditional Pilates exercise methods.

BACKGROUND ART

Developed in 1926 by Joseph Pilates, The Pilates Method is a non-impact exercise technique incorporating principles of yoga. Pilates and his followers developed numerous exercises, most of which require specially designed equipment that typically use coiled springs as a resistance element.

One of the Pilates-designed exercise devices became known as the WUNDA CHAIR® or "Pilates chair." In its original form, the Pilates chair was constructed of two plywood sides, a foot pedal between the sides and hinged at the base, with a plurality of long coil springs between the rear of the chair and the foot pedal to provide resistance. The position of these springs is changed at either the rear of the chair or the foot pedal to vary the resistance of the foot pedal. What prior art Pilates chairs lack, however, are independent foot bars that can be adjusted and the ability to fold into a compact shape for portability and storage.

DISCLOSURE OF THE INVENTION

One embodiment of the present invention is an improved exercise chair with independent, adjustable foot bars. In another embodiment, the foot bars may be used independently or locked together to be used in tandem. The seat is supported by a plurality of support elements, but the seat top itself is preferably at least as wide as the bottommost portions of those support elements. In another embodiment, the support elements are hingeably connected with the seat, so that when not in use, the support elements can be moved closer together and the chair can be folded into a compact shape for portability or storage. In one such embodiment, at least one of the support elements is connected with a platform, which rests at or near the floor during use. The platform provides stability as well as comfort when the user stands or kneels on the platform when using the chair, and can also be made to fold along with the rest of the chair for storage or portability. The independent foot bars may be each attached to extensions that allow the position of the foot bars to be adjusted, and the extensions may be coupled with a lever that is hingeably connected with one or more of the support elements, preferably the rear support elements opposite the foot bars. In another embodiment, one or more resistance elements may be attached at a location beneath the seat, and connected with the lever of the foot bar in one of several pre-set mounting locations along the lever to provide variable resistance.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
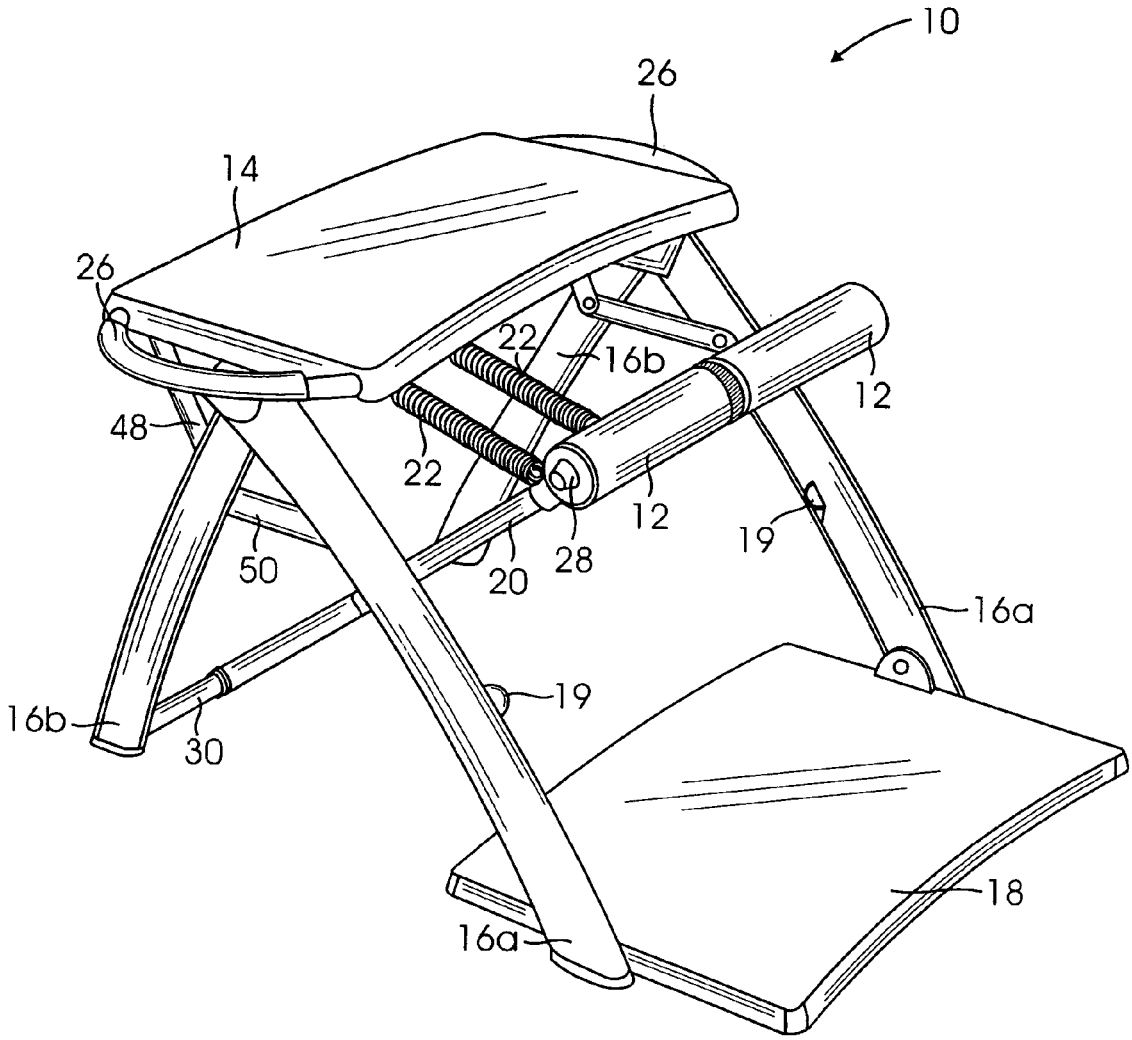
FIG. 1 is a perspective view of one embodiment of the present invention.

As shown in FIG. 1, one embodiment of the present invention is an improved exercise chair 10 with independent foot bars 12. The invention, however, equally contemplates an exercise chair 10 having only one foot bar 12. The two foot bars 12 illustrated in FIG. 1 may be used independently or locked together to be used in tandem as described below. The seat 14 is supported by a plurality of support elements 16. The front support elements 16*a* oppose the rear support elements 16*b*, and thus may be considered opposing support elements. In a preferred embodiment, the support elements 16 are hingeably connected with the seat 14, so that when not in use, the support elements 16 can be moved to fold the chair 10 into a compact shape. In a preferred embodiment the longest dimension of the seat 14 is at least as wide as the bottommost portion of the support elements. In a preferred embodiment, at least one of the support elements 16 is connected with a platform 18, which rests at or near the floor during use, and which can also be made to fold. Each foot bar 12 is attached to a lever 20 that is hingeably connected with one or more of the support elements 16, preferably the support elements at the back of the chair 16*b*. One or more resistance elements 22 are attached at a location below the chair seat 14, such as coupled with the seat bottom, the support elements 16, or a cross bar between the support elements 16, and also coupled with the lever 20.

Figure 3:
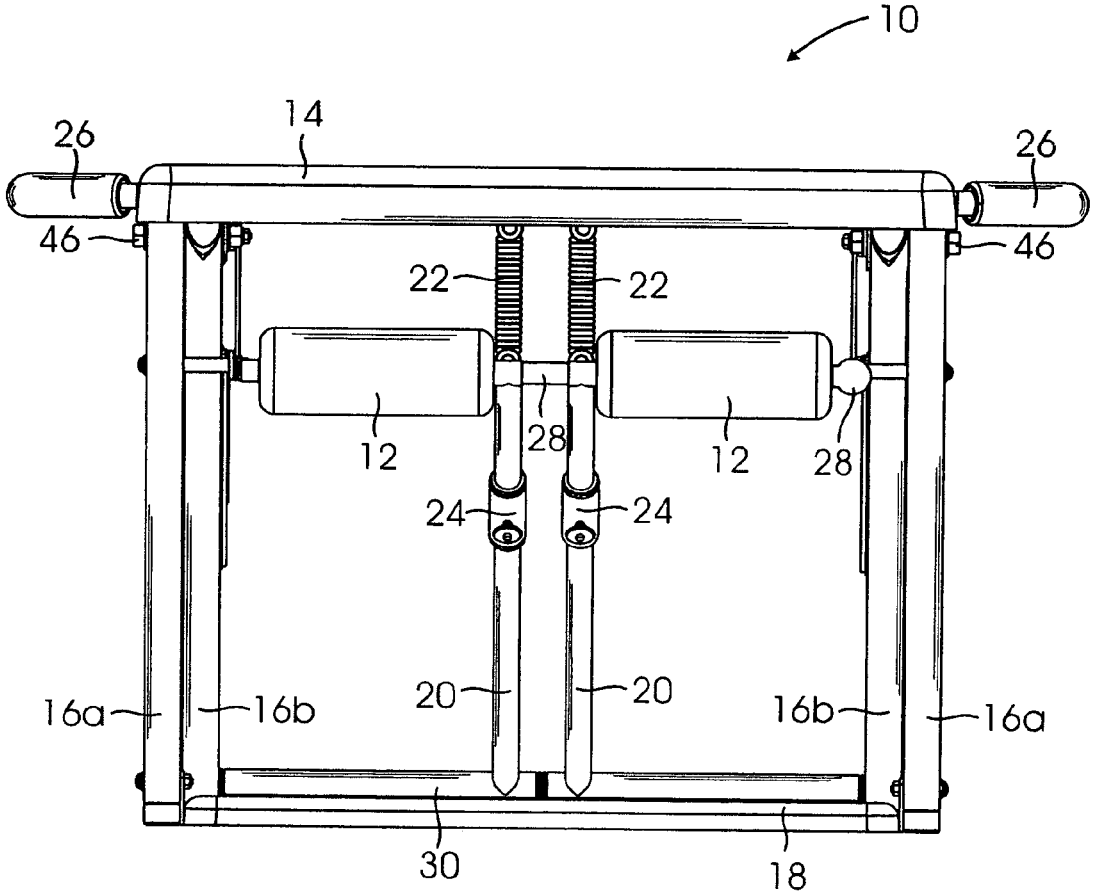
FIG. 3 is a front end view of the embodiment of FIG. 1.

As shown in FIGS. 1 and 3, in its longest dimension the seat 14 of a preferred embodiment is as wide or wider than the support elements 16. This ensures that the chair 10 will fold up compactly. In an alternative embodiment, the bottom of the support elements 16 may be wider than the seat 14, which would provide additional stability during use. The seat 14 preferably has handles 26 attached on either side to help stabilize the user during use of the chair and also to assist portability. In alternative embodiments, no handles or only one handle could be used. The handles may be made to be detachable from the seat by various structures well known to those skilled in the art. Alternatively, the handles 26 may be hinged at their connection points with the seat 14 so that they may be folded up or down while the chair 10 is being used, and for storage. Such hinge mechanisms may be further equipped with locking mechanisms such as holes and pins or tightening screws to hold the handles 26 in place.

In yet another alternative embodiment, the handles 26 may form a "U" shape with straight sides and right angles rather than the gentle curve depicted in the Figures. Such configuration would allow the handles 26 to be mounted with the parallel elements of the "U" shape inserted into openings in the seat 14, so that the handles 26 may be pushed into the openings and out of the way when not in use, and pulled out of the openings for use. As those skilled in the art will appreciate, the openings may be equipped with structures that provide either slight resistance or full locking so that the handles 26 may remain in place unless moved by the user. The openings may be further equipped with hinges to allow the handles 26 to be placed in any position desired by the user, as well as locking mechanisms for the hinges.

Figure 2:
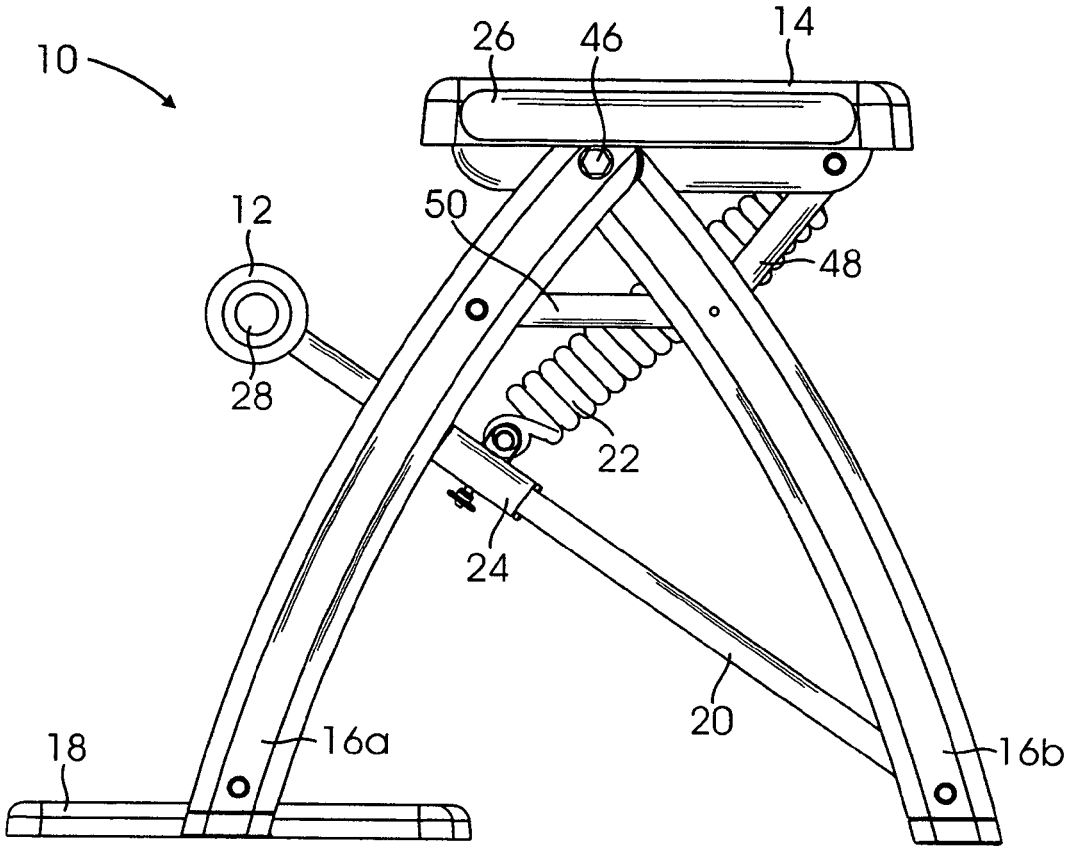
FIG. 2 is a side view of one embodiment of the present invention.
Figure 6A:
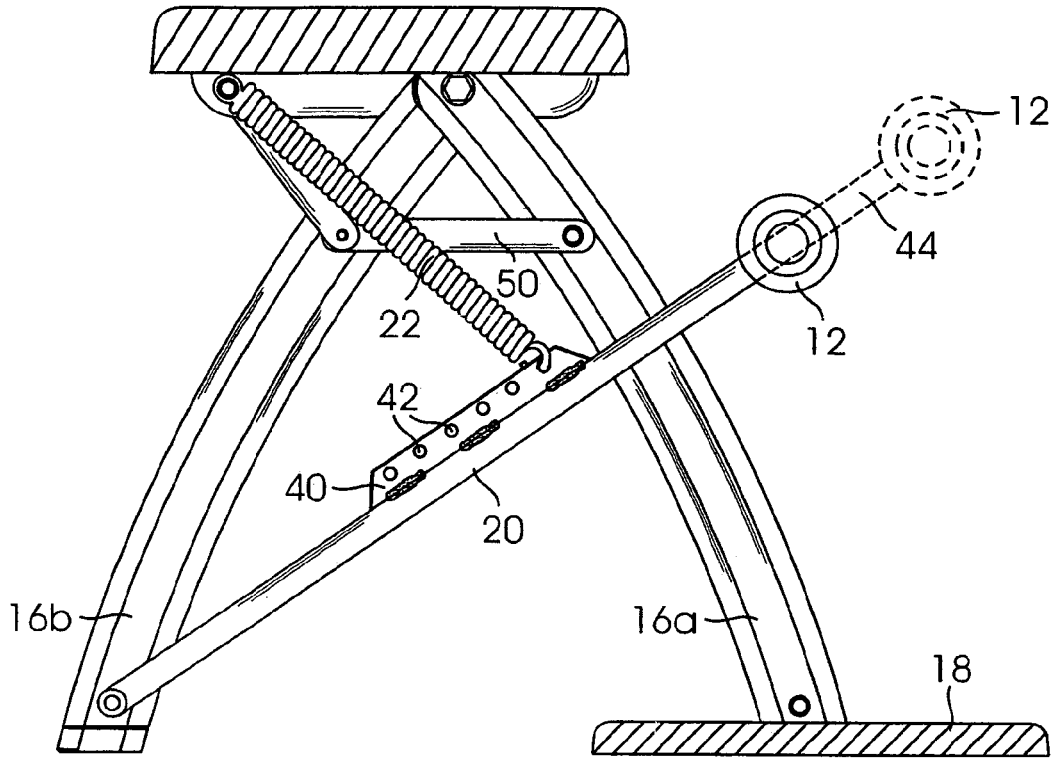
FIG. 6A is a side view of yet another embodiment of the present invention, showing an alternate spring attachment mechanism and an extending foot bar.

As shown in FIGS. 2 and 6A, in a preferred embodiment the chair may be equipped with independent foot bars 12, each with its own attached lever 20 hingeably connected with one or more of the rear support elements 16*b*, and each lever 20 with its own resistance element 22. In such configuration, the foot bars 12 may be used independently, or coupled together to be used as a single unit. The coupling mechanism may be a rod 28 that runs through the center of the hollow foot bars 12, shown in FIGS. 1, 2, and 3, or through holes in both of the levers 20, or any apparatus known in the art that secures the foot bars 12 and/or the levers 20 together such that the two foot bars will move in unison when either is moved. The foot bar 12 is not restricted to be used with the feet; it may be used with a user's hands, knees, legs, or any other part of the body.

A preferred embodiment of the exercise chair 10 allows for the foot bars 12 to be locked together and used as a single solid bar, or unlocked and used independently. Although single solid foot bars are useful and may be necessary for certain exercises, independent foot bars have certain advantages. Among those advantages is the ability to have identical resistance on both appendages being exercised. For example, with a single foot bar acted upon by both of a user's feet, the user's dominant leg will often supply more force to the foot bar than the non-dominant leg. Such uneven forces applied by each leg result in an uneven workout and the perpetuation of one leg and all of the tendons and muscles connected with that leg being stronger than the corresponding muscles and tendons on the other side. In contrast, the present invention allows the use of independent foot bars to assure that equal resistance is applied to each leg. Alternatively, if a user has special needs, such as one appendage being significantly weaker due to a physical condition, the amount of resistance of each lever/foot bar may be tailored to individually suit these appendages. During exercise, the independent foot bars may be pushed down and raised at the same time, as in the original Pilates chair, or may be used alternately to provide a different style of workout.

In a preferred embodiment, the levers 20 connected to the foot bars 12 may be connected at their other end to a cross bar 30 that runs between the two rear support elements 16*b*. The cross bar 30 may be located at the bottom of the rear support elements 16*b*, such as shown in FIG. 3, or anywhere along the rear support elements 16*b*. Alternatively, each lever 20 may be coupled with a single rear support element 16*b* without the need for a cross bar 30.

In yet another alternative embodiment, the cross bar 30 may be coupled with the front support elements 16*a*, rather than the rear support elements 16*b*. Such configuration will change the angle of the lever(s) 20 relative to the seat 14 and the user, and may provide advantageous leverage on the foot bar(s) 12. In alternative embodiments, the platform 18 may be located between the front support elements 16*a*, or the rear support elements 16*b*, or both. In yet another alternative embodiment, an additional brace may be added between the rear support elements 16*b* to stabilize them.

Figure 4:
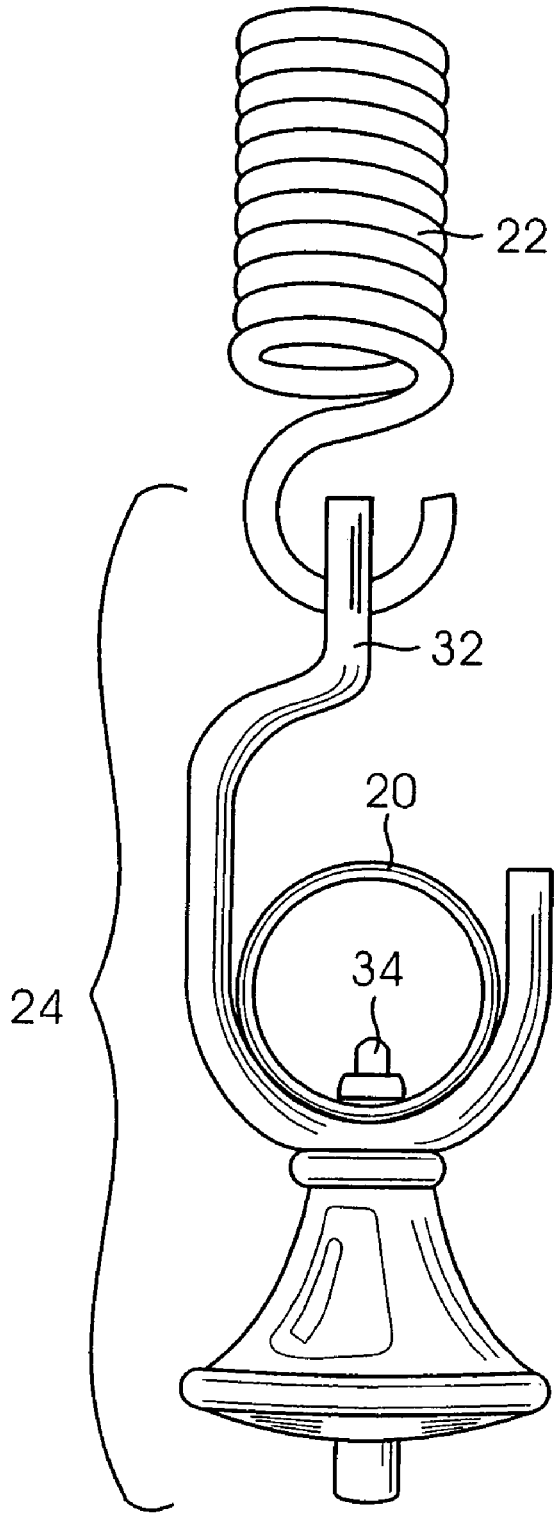
FIG. 4 is a side view of an adjusting assembly that uses a locking pin.
Figure 5:
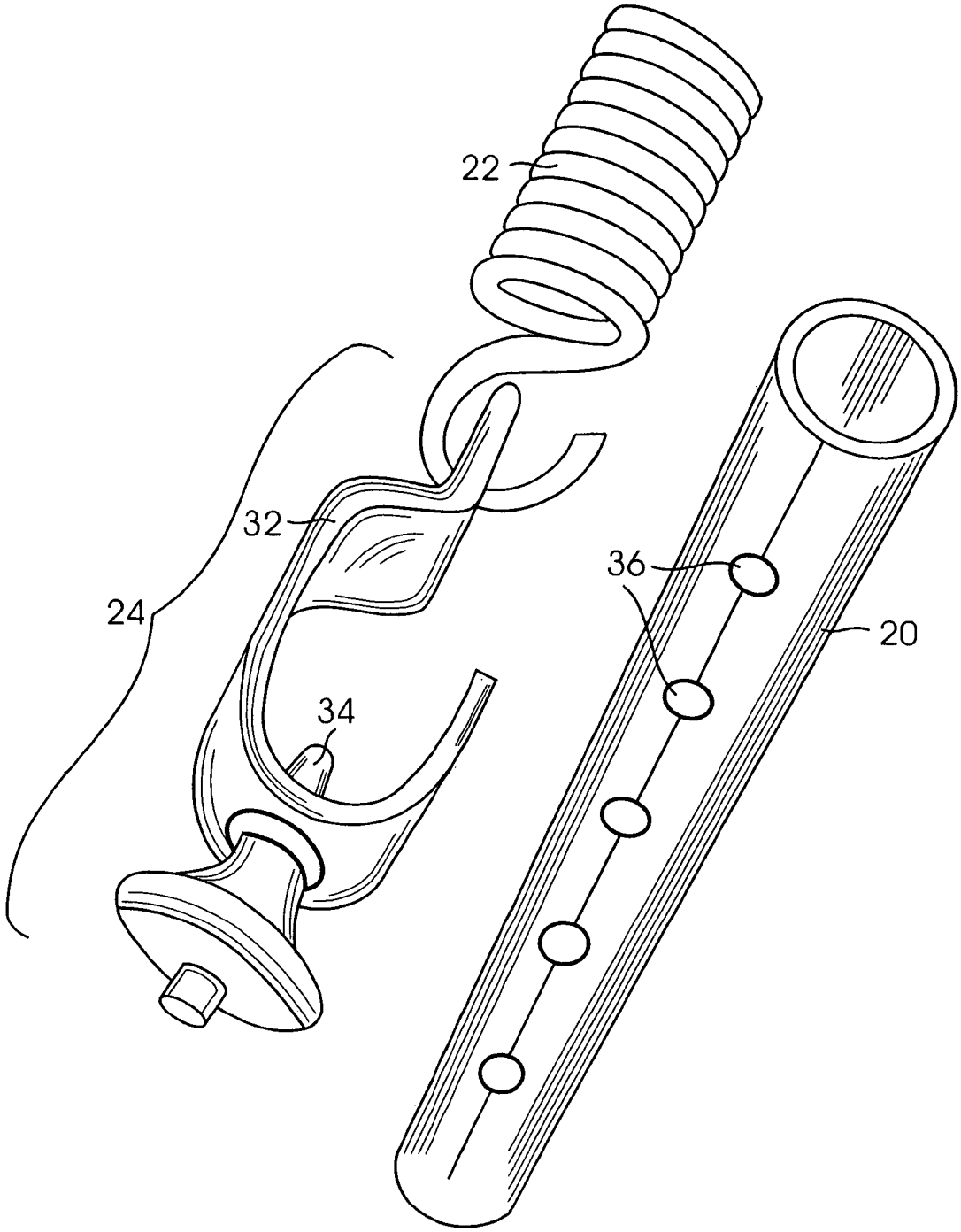
FIG. 5 is a perspective view of an adjusting assembly that uses a locking pin.

As shown in FIGS. 4 and 5, in a preferred embodiment the lever 20 is equipped with a resistance varying mechanism. An adjusting assembly 24, such as a bracket 32 in the shape of a hook with a pin 34 on the interior of the hook, which pin 34 fits into holes 36 or detents in the lever 20 adapted to fit the pin 34, may be used to secure the adjusting assembly 24 in the desired location along the lever 20. In an alternative embodiment, the adjusting assembly bracket 32 could be closed, rather than an open hook, so that it is retained on the lever 20 at all times. In either embodiment, however, the adjusting assembly 24 cannot be slid along the lever 20, as it has to be pulled away from the lever 20 to disconnect the pin 34 from the hole 36. The pin 34 itself could be any shape to fit the holes 36, but a preferred embodiment is a cylinder with a tapered end. The pin 34 may also include a locking mechanism, including but not limited to that found in quick-release aviation fasteners, an example of which includes BALL-LOK® fasteners manufactured by Avibank Mfg., Inc. Such fasteners may either be positive lock, requiring a button to be pushed to retract the balls and release the pin, or detent pins that simply require a sufficient pull on the pin to push the protruding ball into its barrel to extract the pin. Other suitable pin retention mechanisms may also be used.

Alternatively, a simple lock button mechanism may be used as a resistance varying mechanism, similar to those found on two-piece kayak paddles, which comprise an inner shaft with a single hole, through which a spring-loaded button protrudes, and an outer shaft that closely fits over the inner shaft is equipped with holes. The spring-loaded button is pushed down, allowing the outer shaft to be slipped over the inner shaft, until the button pops up though one of the outer shaft holes, locking the shafts together. In such an embodiment the resistance element may be coupled with a sleeve that closely fits and slides on the lever, a plurality of holes in the sleeve, and a spring-loaded button protruding from the lever, said button adapted to fit the holes in the sleeve.

Figure 6B:
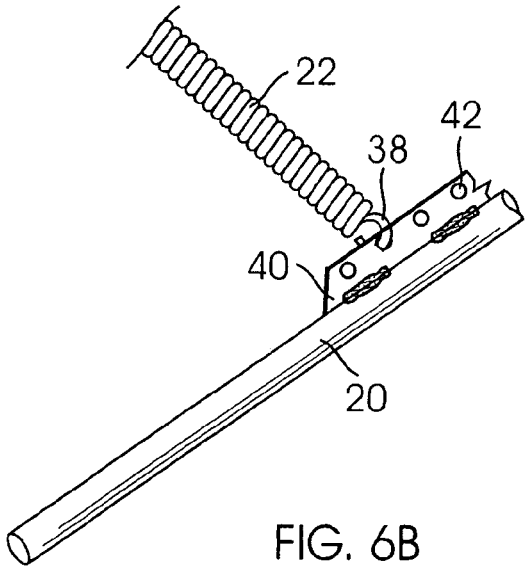
FIG. 6B is a perspective view of the alternate spring attachment mechanism shown in FIG. 6A.

As shown in FIGS. 6A and 6B, in yet another alternative embodiment, the resistance varying mechanism may consist of a hook and eyelet structure. The hook 38 may either be part of the resistance element 22 itself, or a separate hook 38 may be attached to the end of the resistance element 22. Attached to the lever 20 is an eyelet member 40, a length of material with eyelets 42 in it, to which the hook 38 may be attached. Preferably, the eyelet member 40 may be a planar shaped element attached along its side to the lever, and having eyelets 42 along its length. The eyelet member 40 is preferably composed of a material that when firmly affixed to the lever 20 though welds, bonding, or other suitable affixation, imparts structural strength to the lever 20 and distributes the load of the resistance element 22 over a larger area. As those skilled in the art will appreciate, the eyelet member 40 may be attached to the lever 20 via a wide variety of methods, including but not limited to welding, bonding, gluing, bolting, screwing, strapping, or any other suitable method. Although FIGS. 6A and 6B depict the eyelet member 40 coupled with the topside of the lever 20, it may be placed in any desired position, such as on the side or the underside of the lever 20.

In another embodiment that is not depicted in the drawings, the eyelet members 40 may be used with eye bolts (eyebolts). In such an embodiment, the threaded portion of an eye bolt is inserted into an eyelet 42 and secured onto the eyelet member 40 by threading a nut onto the eye bolt. The user would then attach the resistance element 22, either directly or with the use of a hook 38, onto the eye portion of the eye bolt. One eye bolt per eyelet member 40 could be used, or one eye bolt for every eyelet 42, or any combination thereof. Alternatively, the eyelet member 40 could be comprised of one or more eye bolts installed substantially perpendicularly through the lever 20, or attached to the outside of the lever 20 via any suitable attachment mechanism, such as welding.

As will be appreciated by those skilled in the art, in yet another alternative embodiment, the resistance varying mechanism, in the form of an adjusting assembly 24, could be infinitely adjustable. Such an embodiment may use a lever 20 without holes and a clamp on the adjusting assembly 24, which may comprise a tightening screw or other suitable device to tighten and secure the adjusting assembly 24 in any desired position on the lever 20.

As shown in FIG. 6A, the foot bars 12 may be extendable and locked into position at any desired length. In such an embodiment, each foot bar 12 may be coupled with a lever 20 via an extension member 44, which is preferably a length of tubing that fits inside its respective lever 20, so that the foot bar 12 can be extended simply by pulling the extension member 44 out of the lever 20 and locking it in place in the desired position. The locking mechanism may be the pin mechanism discussed above, wherein the lever 20 and the extension member 44 have holes 36 set at the same spacing, and the pin 34 may be placed such that it engages the holes 36 in both the lever 20 and the extension member 44, locking them both in place. Alternatively, the extension member 44 may be locked in place using its own separate hole and pin structure, which may be located on the lever 20 at the end nearest the foot bar 12. Alternatively, the lock button mechanism described above for the adjusting assembly 24 and lever 20 may be used with the extension member 44 and the lever 20. In yet another embodiment, the extension member 44 may be locked in place by other structures, such as clamping or screw mechanisms at or near the end of the lever 20 that tightens on or around the extension member 44.

Although the lever 20 is preferably constructed of tubing that surrounds the extension member 44, alternative embodiments may reverse that assembly, using an extension member 44 that surrounds the lever 20. In such embodiments, the adjusting assembly 24 could be fixed to the extension member 44 and resistance could be adjusted by moving the extension member 44, or the adjusting assembly 24 could be made to adjust via the same types of structures disclosed above. Similarly, although the preferable construction materials for the levers 20 and extension members 44 are cylindrical or square tubing, one of which one slides within the other, various other materials could be used, such as tubing with cross sections of other shapes, interlocking channels, channels used with tubing, or any other suitable construction with the requisite strength.

In yet another embodiment, the extension member 44 may be integrated into the lever 20 such that neither could move relative to the other, but rather comprise one long structure. In such an embodiment, the foot bar 12 could simply be moved to and secured at any point along the structure.

The extendable foot bars 12 have several advantages over non-extendable bars. Among these advantages is the ability of the chair 10 to adapt to users of various sizes. In addition, the use of independent foot bars 12 in the present invention, coupled with the ability of these foot bars 12 to extend, presents further advantages. For example, if a user suffers from physical limitations, such as one leg shorter than the other or an appendage with a limited range of motion, which require each foot bar 12 to be in a different position, the position of the foot bars 12 may be individually tailored to the user's needs. Yet another advantage to the extendable foot bars 12 is the ability of the chair 10 to fold more compactly by either retracting the extension member 44 fully for folding, or removing one or both extension members 44 and their associated foot bars 12 altogether prior to folding.

In a preferred embodiment, a resistance element 22 of one coil spring may be used with each lever, as shown in FIGS. 1 and 3. In alternative embodiments, more than one spring could be used for each lever 20, either as full-time attachments or as a removable resistance elements 22 to tailor the precise resistance to the individual's needs. Alternative resistance elements 22 may also be used, such as elastic cords, flexible rods, leaf springs, pistons, or a weight and pulley system, or combinations thereof, all of which are well-known in the exercise arts. In other alternative embodiments, one or more resistance elements 22 could be commonly attached to the independent levers 20, such as a single elastic cord with each end attached to separate levers 20 and the interior portion of the elastic cord restrained at some distance from the levers 20 to provide sufficient resistance. In still other embodiments, a single lever 20 and foot bar 12 may be used with these resistance elements.

Certain resistance elements 22, such as elastic cords, may be routed in a variety of configurations to provide resistance. For example, one end of an elastic cord may be attached to a point near the bottom of the chair 10, such as to the support element 16 or a crossbar 30 between the support elements 16, routed through an eye bolt or over a bar under the seat 14, and the other end attached to the lever 20. Continuous loops of elastic cord may be similarly routed.

In another embodiment not depicted in the drawings, for resistance elements 22 such as springs and elastic cords whose resistance varies with the amount they are stretched, the tension on the resistance element 22 may be varied by use of a turnbuckle. This turnbuckle may be coupled with either end of a resistance element 22 or in the middle of two lengths of resistance element. For example, one end of the turnbuckle may be coupled with the lever 20 and the other end to the resistance element 22, and the resistance element 22 could then be coupled with the underside of the seat 14. The reverse configuration may also be used, with the turnbuckle coupled with the seat 14. In addition, more than one turnbuckle may be used, such as one coupled with the lever 20 and another coupled with the seat 14, with the resistance element 22 coupled between the two turnbuckles. Lengthening the turnbuckle(s) would reduce the resistance, whereas shortening the turnbuckle(s) would increase the resistance.

Figure 7:
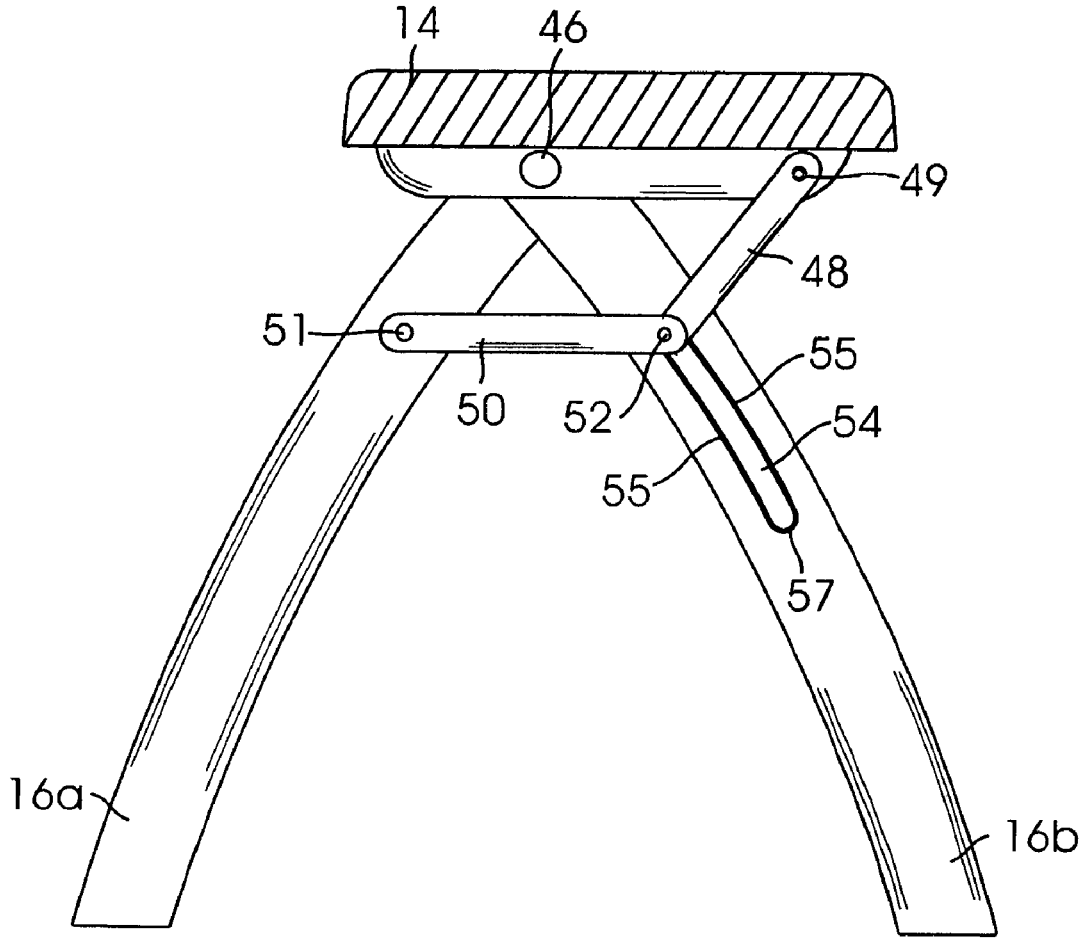
FIG. 7 is a cross section view of a folding embodiment of the chair in the unfolded position.

As shown in FIGS. 1, 2, 7, and 8, the folding mechanism in a preferred embodiment may have a common hinge 46 shared by the seat 14 and two support elements 16 on either side. A restraining mechanism may be employed so that during use, the opposing support elements and the seat are locked into the proper positions. In a preferred embodiment, this restraining mechanism may be used on at least one lateral side of the chair 10, with one end of a first strut member 48 attached to the underside of the seat 14, at a hinge point 49, rearward of the common hinge 46. Also on that lateral side of the chair 10, one end of a second strut member 50 may be attached at a hinge point 51, to the front support element 16*a*. The other ends of these strut members 48, 50 may be joined together by a pivot pin 52, said pivot pin 52 being further captured in a structure defining a slot 54 that runs substantially parallel to the rear support element 16*b*. Said structure defining a slot 54 may be either formed in the support element 16*b* itself or attached to the support element 16*b* as a separate structure. The structure defining a slot 54 preferably has an elongated shape, with a camming surface 55 on each of the two long sides and stop surfaces 57 on each of the distal ends. This restraining mechanism operates so that when the chair 10 is in the open position, as shown in FIG. 7, pushing down on the back of the seat (above hinge point 49) will cause the strut member 48 to force the pivot pin 52 to move downward in the structure defining a slot 54. As the pivot pin 52 moves in the structure defining a slot 54, its camming surfaces 55 apply force to the pivot pin 52, which in turn applies force to the strut member 50, which in turn acts on the front support element 16*a* via the hinge point 51.

Figure 8:
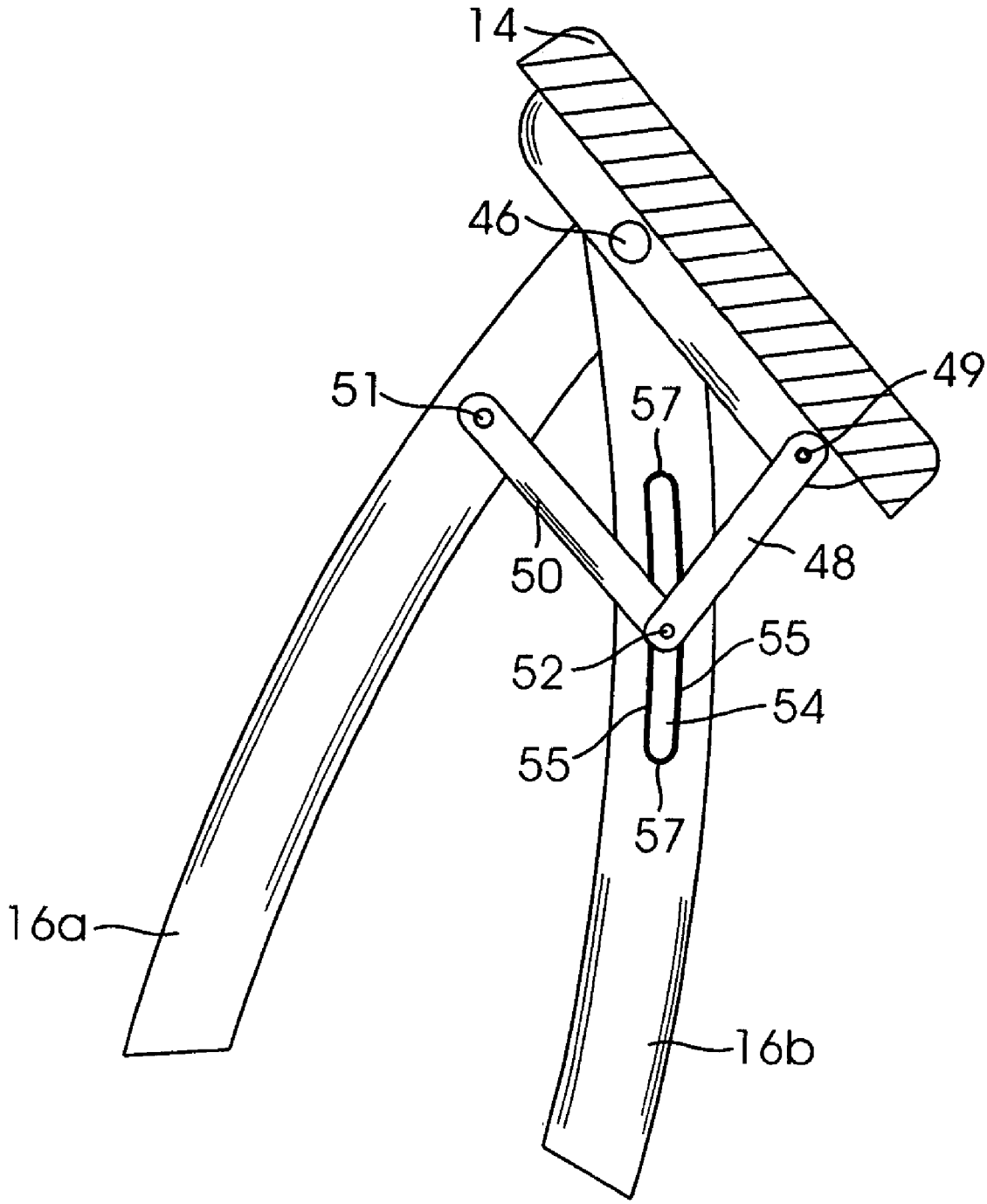
FIG. 8 is a cross section view of the chair shown in FIG. 7, in the partially folded position.

As shown in FIG. 8, the combination of the forces applied by the strut members 48, 50, the pivot pin 52, and the camming surfaces 55, cause the support elements 16 to move more parallel, and rear of the seat 14 to move downward. Such motions allow the chair 10 to be folded into a compact shape for transport or storage, and when motions are reversed, to unfold the chair 10 for use. Thus folding or unfolding the chair 10 could be accomplished by a number of methods, simply by applying the appropriate force to the seat 14, the support elements 16, the pivot pin 52, or the strut members 48, 50, either individually or in combination. When the pivot pin 52 reaches either of the stop surfaces 57, the seat 14 and the support elements 16 are prevented from moving any further, and thus the stop surfaces 57 act to prevent the chair 10 from opening or folding any further than designed. In a preferred embodiment, there are strut members 48, 50, structures defining slots 54, and pivot pins 52 on both sides, one set on each of the support elements 16, but in other embodiments they may be on only one side.

Although the FIGS. 1, 2, and 6A depict, and the above description describes, the. connection of the first strut member 48 to the rear of the seat 14, in an alternative embodiment the configuration may be reversed so that the first strut member 48 is coupled with the front of the seat 14, and the slot 54 and the pivot pin 52 are on the front support element 16*a*. The position of the seat 14 may have to be adjusted relative to the hinge 46 to accommodate this reversed folding and restraining mechanism, but is well within the skill of those versed in the art.

In an alternative embodiment of the folding and restraining mechanisms, the first strut member 48 may be eliminated, and one of the support elements may be affixed to the seat such that the seat 14 is held in the proper position when the support elements 16 are unfolded for use. In such an embodiment, the pivot pin 52 in the second strut member 50 may be pulled against the top stop surface 57 of the structure defining a slot 54 to lock the support members and the seat in place during use. In such an embodiment, the pivot pin 52 may alternatively be affixed to either support element 16, and the structure defining a slot 54 could be located in the second strut member 50, such that the pivot pin 52 simply acts as a stop for the second strut member 50 to prevent the support elements 16 from spreading beyond their design limits.

Figure 9:
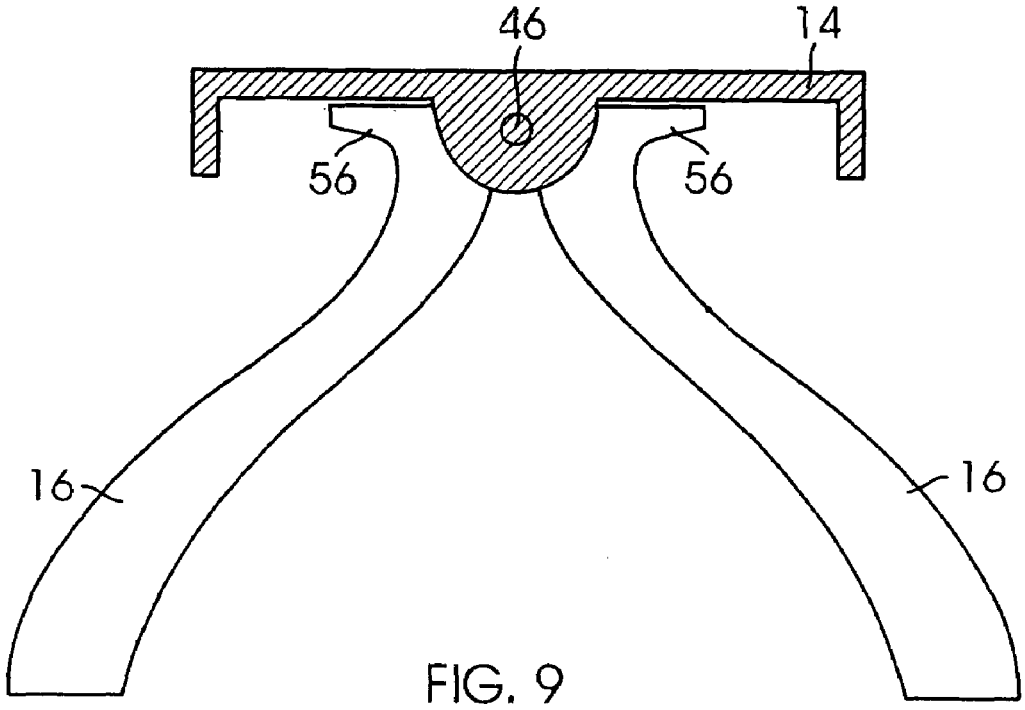
FIG. 9 is cross section view of an alternate embodiment showing an alternate folding mechanism for the support elements in the unfolded position.
Figure 10:
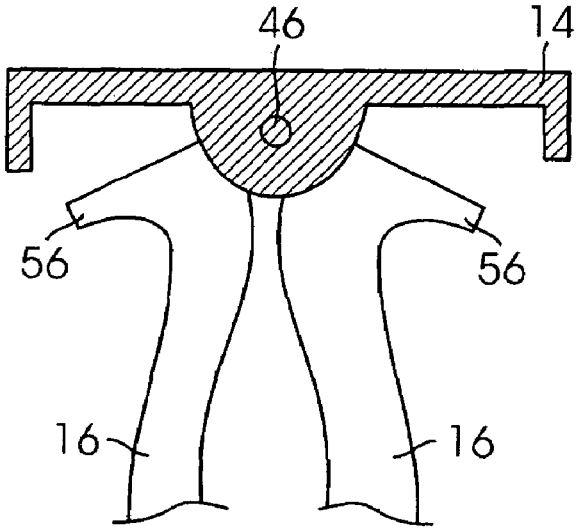
FIG. 10 is cross section view of the embodiment shown in FIG. 9, in a partially folded position.

In other embodiments of the folding and restraining mechanisms, the strut members 48, 50, structures defining slots 54 and pivot pins 52 may be replaced by other structures. In such embodiments, the seat 14 may fold at the common pivot point 46 in either direction or both directions. To fold the chair, the support elements 16 may simply be moved towards each other. When unfolded, the front and rear support elements 16*a*, 16*b* may be restricted from opening wider than desired by standard mechanical elements known to those skilled in the art. Similarly, the seat 14 may be held in the proper position by standard mechanical elements located in either the pivot 46 or the support elements 16 when the support elements 16 are spread to their fully opened position. For example, as shown in FIG. 9, the support elements 16 may share a common pivot point 46, and protruding from the support element 16 are stops 56 that restrict the support elements 16 from opening farther than they should and hold the seat 14 in the proper position when the support elements 16 are fully opened. As shown in FIG. 10, folding the chair 10 simply requires the support elements 16 to be pushed together. Although the figures depict both support elements 16 as being hinged, one could be fixed to the seat 14 and the other hinged. Alternatively, the stop(s) 56 could be integrated into the seat 14 rather than the support element 16, or into the hinge 46 itself.

Figure 11:
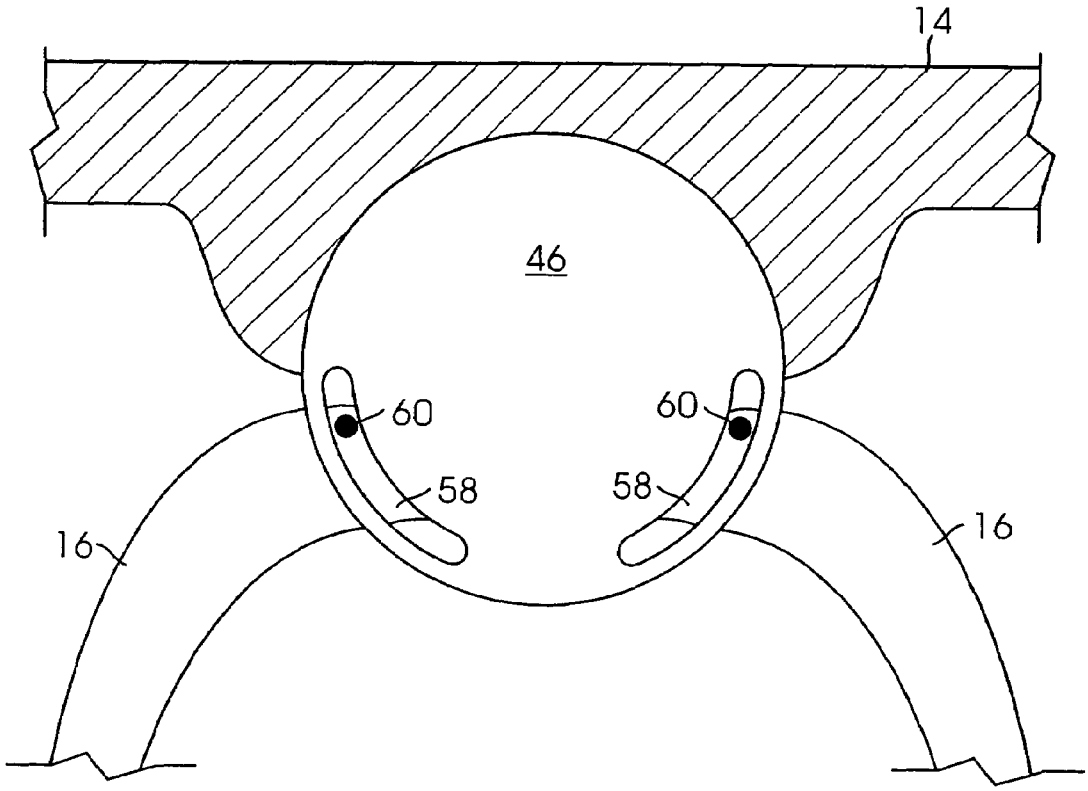
FIG. 11 is a cross section view of another embodiment showing an alternate folding mechanism for the support elements in the unfolded position.

FIG. 11 depicts an example of another alternate embodiment of the folding and restraining mechanisms. The support elements 16 and the seat 14 share a common pivot or hinge 46. But rather than having stops, the common pivot or hinge 46 is equipped with openings 58, into which are fitted stop pins 60. The stop pins 60 are set into the support elements 16, so that the openings 58 limit the range of motion of the support elements 16 into which the stop pins 60 are set. Alternatively, this configuration could be reversed; the openings 58 may be coupled with the support elements 16, and the stop pins 60 set into the hinge 46 that is coupled with the seat 14. Either way, folding or unfolding is accomplished by moving the support elements 16 together or apart, respectively. Alternatively, one of the openings 58 and its associated stop pin 60 could be eliminated by fixing that side's support element 16 to the seat 14, and thus folding would require moving the one hinged support element 16 towards the non-hinged support element 16. The seat 14 could be fixed to the common pivot or hinge structure 46, or it could be independently hinged and held in place when the seat is fully opened by again using stops 56 as shown in FIG. 9. Another such embodiment could hinge either the front or rear support elements 16*a*, 16*b*, leaving the non-hinged support elements affixed with the seat 14, either at the hinge point 46 or elsewhere. In such an embodiment, the user would simply fold the hinged support elements towards the non-hinged support elements.

Although the embodiments discussed above and depicted in the figures use a common pivot point or hinge 46 for the opposing support elements 16*a*, 16*b*, the support elements 16 may be located at independent positions on the seat, and use independent pivot points or hinges to accomplish a similar folding structure. Similarly, the hinge point for one of the support elements 16 may be located somewhere on the opposing support element 16 rather than the seat 14. As those skilled in the art will appreciate, the folding and restraining mechanisms depicted in FIGS. 7 and 8 may be used in such an embodiment with only minor adjustments in the geometry of the strut members 48, 50. As discussed above as alternative embodiment, the first strut member 48 could be eliminated so long as provisions are made for the seat 14 to be fixed in the proper position during use. Such provisions could include affixing one support element 16 rigidly to the seat, using stops 56 affixed to one or both of the support, elements 16 as depicted in FIGS. 9 and 10, or using openings 58 and stop pins 60 as depicted in FIG. 11. Alternatively, the folding and restraining mechanisms depicted in FIGS. 9, 10, and 11 may be used with independently hinged support elements 16, without the need for any strut members 48, 50. In such embodiments, one or both of the opposing support elements 16 may be hinged.

As shown in FIGS. 1 and 2, the platform 18 is preferably attached to the front support elements 16*a,* with equal amounts of the platform 18 extending from each side. In an alternative embodiment, the platform 18 could be made to slide between the front support elements 16*a,* to provide a variable amount of platform 18 on either side of the front support elements 16*a.* Such a configuration would also allow the platform 18 to be placed into an optimal position for folding to minimize the space needed for the chair 10 in a folded configuration. Alternatively, the platform 18 could be designed with a variety of attachment points, either quick-release or semi-permanent, so that the user could decide the configuration, including removal from the chair 10. Alternatively, the platform 18 could be attached at or near its corners to the front support elements 16*a,* and hinged so that it can be aligned with the front support elements 16*a* to fold compactly. In such a configuration, the platform 18 could be folded either out away from the chair 10 or folded in towards the chair 10 during use or storage. In all of the above embodiments, a platform stop 19 may be used to keep the platform 18 in place when not in use, such as during storage or transport. The platform stop 19 may simply be a protrusion from the support element 16, or as those skilled in the art will appreciate, may be designed to hold the platform 18 in place when in the folded position, by standard mechanical means, such as spring-loaded friction surfaces or catches, pin/detent mechanisms, or the like. In an alternative embodiment, no platform 18 need be used, it could either be omitted from the design or used as an optional detachable element.

As those skilled in the art will appreciate, although the exercise chair 10 is preferably constructed of cylindrical or square metal tubing, the various parts may be constructed of any material in any configuration that offers suitable strength. Examples of such configurations may include tubing with oval, square, rectangular, triangular, or polygonal cross sections, open or closed channel, solid materials of any configuration where an open or hollow design is not required, or any other suitable shape. Regardless of their shape, however, such materials should be light enough to maintain the portability of the exercise chair 10, examples of which may include light gauge steel, lighter metals such as aluminum, titanium, or magnesium, plastic, fiberglass, composites such as carbon fiber, or any other suitable materials. Given that the exercise chair 10 is likely to be exposed to the perspiration of the user, preferably, although not necessarily, such materials would either be inherently resistant to corrosion, or coated or treated with suitable materials to prevent corrosion, examples of which may include plastic coatings, powder coatings, durable paint, galvanizing, or anodizing.

Accordingly, an improved exercise chair is disclosed. Although embodiments and applications of this invention have been shown, it would be apparent to those skilled in the art that many more modifications are possible without departing from the inventive concepts herein. The invention, therefore, is not to be restricted except in the spirit of the appended claims.

What is claimed is:

1. An exercise chair comprising
a front support element,
a rear support element,
a seat coupled with the front support element and the rear support element,
a lever hingeably coupled with the rear support element,
a foot bar coupled with the lever, and
a resistance element, secured at one location below the seat and at another location coupled with the lever,
a structure defining an elongated slot coupled with the rear support element,
a pivot pin contained within the slot,
a support element hingeably coupled with the seat, and
a pair of strut members, each having two ends, the first end of the first strut member hingeably coupled with the front support element, the first end of the second strut member hingeably coupled with the seat, and the second ends of each strut member hingeably coupled with each other at the pivot pin,
wherein at least one support element is hinged so that the exercise chair can fold into a compact shape when not in use.

2. The exercise chair of claim 1, further comprising
an extension member coupled with the foot bar, and further slidably coupled with the lever, and
a locking mechanism for the extension member chosen from at least one of the group consisting of:
(a) holes formed in the extension member and the lever, and a pin adapted to fit within the holes,
(b) a plurality of holes formed in the lever, and
a spring-loaded button protruding from the extension member,
said button adapted to fit the holes in the lever,
(c) a clamp, and
(d) a tightening screw.

3. The exercise chair of claim 1, further comprising a coupling mechanism for two foot bars, chosen from at least one of the group consisting of:
(a) a hollow portion in both foot bars, and
a rod adapted to fit into both such hollow portions,
(b) at least one hole in both levers, and
a rod adapted to fit within holes in both levers, and
(c) at least one hole in both extension members, and
a rod adapted to fit within holes in both extension members.

4. An exercise chair comprising
a seat,
two opposing support elements, at least one support element having a hinge allowing it to move relative to the other, and at least one support element coupled with the seat,
a lever hingeably coupled with at least one of said support elements and the further coupled with an extension member,
a foot bar coupled with the extension member,
a resistance element, secured at one location below the seat and at another location coupled with at least one lever, and
a folding and restraining mechanism chosen from at least one of the group consisting of:
(a) a pair of strut members, each having two ends,
a structure defining an elongated slot coupled with the first of the support elements,
said slot containing a pivot pin,
wherein first end of the first strut member is hingeably coupled with the second of the support elements, the first end of the second strut member is hingeably connected with the seat, and the second ends of each strut member are both coupled with the pivot pin, (b) a stop coupled with at least one hinged support element, (c) a stop coupled with the seat, adapted to contact at least one hinged support when the chair is fully opened, (d) a stop pin coupled with the seat, said stop pin set within a structure defining an opening coupled with the hinged support element, and (e) a stop pin coupled with the hinged support element, said stop pin set within a structure defining an opening coupled with the seat.

5. The exercise chair of claim 4, further comprising an eyelet member coupled with the lever, said eyelet member defining at least one eyelet, and a hook coupled with at least one resistance element and adapted to fit in the at least one eyelet.

6. The exercise chair of claim 4, further comprising at least one resistance varying mechanism chosen from the group consisting of:

(a) a turnbuckle coupled with the resistance element, (b) an adjusting assembly interposed between and coupled with the resistance element and at least one lever, comprising a bracket adapted to fit the lever, a pin coupled with the bracket and further coupled with one of a plurality of holes along the lever, (c) an adjusting assembly interposed between and coupled with the resistance element and at least one lever, comprising a sleeve that closely fits and slides on the lever, a plurality of holes in the sleeve, and a spring-loaded button protruding from the lever, said button adapted to fit the holes in the sleeve, (d) an adjusting assembly interposed between and coupled with the resistance element and at least one lever, comprising a clamp that can be tightened at any position along the lever, and (e) an eyelet member coupled with the lever, wherein the eyelet member contains eyelets along its length, and a hook coupled with at least one resistance element, wherein the hook is adapted to fit in the eyelets.

7. The exercise chair of claim 4, further comprising at least two foot bars, a hollow space defined by at least a portion of each foot bar, and a rod adapted to fit within the hollow space of each foot bar.

8. The exercise chair of claim 4, having at least two foot bars, at least two extension members and at least two levers, and further comprising a locking mechanism for the foot bars chosen from at least one of the group consisting of:

(a) a hollow space defined by at least a portion of each foot bar, and a rod adapted to fit within the hollow space of each foot bar, (b) a hole formed in each lever, and a rod adapted to fit within a hole in each lever, and (c) a hole formed in each extension member, and a rod adapted to fit within a hole in each extension member.

9. The exercise chair of claim 4, further comprising a handle coupled with the seat.

10. The exercise chair of claim 9, wherein the coupling between the seat and the handle comprises at least one hinge.

11. The exercise chair of claim 9, wherein the coupling between the seat and the handle is removable.

12. An exercise chair comprising two front support elements whose bottommost portions define a front width, two rear support elements whose bottommost portions define a rear width, a seat whose longest dimension is at least as wide as the front and rear widths, a hinge coupled with the seat, at least one of the rear support elements, and at least one of the front support elements, a platform coupled with each of the front support elements, a cross bar coupled with each of the rear support elements, two levers, each hingeably coupled with the cross bar and each coupled with an extension member, each extension member coupled with a foot bar, an eyelet member containing at least one eyelet, said eyelet member coupled with at least one lever, at least one resistance element, secured at a location below the seat and coupled with the at least one eyelet, a structure defining a slot coupled with one of the rear support elements, a pivot pin restrained in the slot, a first strut member hingeably coupled with at least one front support element, and a second strut member hingeably coupled with the seat, wherein both strut members are also hingeably coupled with each other at the pivot pin.

13. The exercise chair of claim 12, further comprising a locking mechanism for the foot bars, chosen from at least one of the group consisting of:

(a) a longitudinal hollow space defined by each of the foot bars, and a rod adapted to fit within the hollow space of each foot bar, (b) at least one hole within each extension member, and a rod adapted to fit within such holes, and (c) at least one hole within each lever, and a rod adapted to fit within such holes.

14. The exercise chair of claim 12, wherein the coupling between the levers and their extension members is a slideable coupling, and further comprising a locking mechanism for at least one of the extension members chosen from at least one of the group consisting of:

(a) holes formed in the extension member and the lever, and a pin adapted to fit within the holes, (b) a clamp, (c) an extension member that closely fits and slides on the lever, a plurality of holes in the extension member, and a spring-loaded button protruding from the lever, said button adapted to fit the holes in the extension member, and (d) a tightening screw.

15. The exercise chair of claim 12 further comprising a handle coupled with the seat.

16. An exercise chair comprising a front support element, a rear support element, a seat whose longest dimension is at least as wide as the bottommost portion of the support elements when said support elements are in their use position, a foot bar, a resistance element, a lever coupled with at least one foot bar and means for coupling the other end with the rear support element, a resistance element connected below the seat and along the lever, means for varying the resistance of the resistance element, and means for folding the chair into a compact shape when not in use.

17. The exercise chair of claim 16, further comprising means for restraining the support elements and the seat in their proper positions during use.

18. The exercise chair of claim 17, further comprising at least two levers at least two foot bars, and means for coupling the foot bars so they move in unison.

19. The exercise chair of claim 17, further comprising an extension member interposed between the foot bar and the lever, means for extending the position of the at least one foot bar, and means for locking the foot bar into a desired position.

20. A method of using an exercise chair, comprising unfolding the front and rear support elements to their operating position, locking the seat and the support elements in their operating positions, varying the resistance of a resistance element coupled with a lever, which lever is coupled with a foot bar, placing the bottommost portions of the support elements on a substantially horizontal surface, exercising by placing a body part on a foot bar, placing another body part elsewhere on the exercise chair, and exerting force on the foot bar so that the resistance element is engaged to provide resistance, and folding the seat into a compact shape for transport or storage, which comprises pushing down on one side of the hinge coupled with the seat, which causes a first strut member coupled with the seat to push down upon a pin captured in a slot on a support element, which causes a second strut member coupled with the pin to pull on the opposing support element, which causes the opposing support elements to come together as the one side of the hinged seat is pushed down.

21. The method of using the exercise chair of claim 20, specifically the folding of the chair into a compact shape for transport or storage, further comprises folding a platform attached to at least one front support element so that it is substantially parallel with the front support element.

22. A method of using an exercise chair, comprising unfolding the front and rear support elements to their operating position by pulling up on one side of the hinged seat, which acts on a first strut member coupled with the seat at one end and coupled with a pivot pin at its other end, said pivot pin being restrained in a structure defining a slot on at least one rear support element, the lengthwise edges of said slot defining camming surfaces and the distal ends of said slot defining stop surfaces, said pivot pin also coupled with one end of a second strut member whose other end is coupled with at least one front support element, so that when the rear portion of the hinged seat is pulled up, the first strut member pulls the pivot pin upward in the slot, wherein the pivot pin's travel is restricted by the camming surfaces, which causes the second strut member to act on the front and rear support elements to move the front and rear support elements apart as the one side of the seat moves up, locking the seat and support elements in their operating positions by pulling up on the one side of the seat until the pivot pin contacts the uppermost stop surface in the structure defining the slot, placing the bottom portion of the front and rear support elements on a substantially horizontal surface, determining whether to vary the resistance a resistance element coupled with at least one lever, determining whether to adjust the position of a foot bar coupled with a lever by positioning an extension member coupled with the foot bar and the lever, locking the foot bar into place, placing a body part on a foot bar, and exercising by exerting force on the foot bar with body part.

23. The method of using an exercise chair of claim 22, further comprising choosing whether to couple at least two independent foot bars together, and adjusting the coupling mechanism to effect the choice.

24. The method of using an exercise chair of claim 23, further comprising folding the seat into a compact shape by pressing down on one side of the hinged seat, which acts on a first strut member coupled with the seat at one end and coupled with a pivot pin at its other end, said pivot pin being restrained in a structure defining a slot coupled with one support element, the lengthwise edges of said slot defining camming surfaces and the distal ends of said slot defining stop surfaces, said pivot pin also coupled with one end of a second strut member whose other end is coupled with the opposing support element, so that when one side of the hinged seat is pushed down the first strut member pushes the pivot pin downward in the slot, wherein the pivot pin's travel is restricted by the camming surfaces, which causes the second strut member to act on the opposing support elements to move the opposing support elements closer together as the one side of the seat moves down, and pushing the one side of the seat down until the pivot pin contacts the lowermost stop surface of the slot.

* * * * *